US005595100A

United States Patent [19]

Sollo

[11] Patent Number: 5,595,100

[45] Date of Patent: Jan. 21, 1997

[54] HAND GUARD FOR LOCKING PLIERS

[76] Inventor: Robert E. Sollo, 1132 Ocean Ave., New London, Conn. 06320

[21] Appl. No.: 571,127

[22] Filed: Dec. 12, 1995

[51] Int. Cl.[6] ..... B25B 7/02

[52] U.S. Cl. ..... 81/427; 81/367; 81/417

[58] Field of Search ..... 81/367, 416, 417, 81/427, 427.5

[56] References Cited

U.S. PATENT DOCUMENTS

| | | | |
|---|---|---|---|
| 444,035 | 1/1891 | Wyatt | 81/427.5 X |
| 801,151 | 10/1905 | McKeever . | |
| 2,057,201 | 10/1936 | McCluskey | 81/427.5 |
| 2,293,002 | 8/1942 | Huffman . | |
| 2,409,627 | 10/1946 | Helgeson . | |
| 4,229,924 | 10/1980 | Teachout | 81/427 X |
| 4,574,808 | 2/1986 | King . | |
| 4,811,637 | 3/1989 | McCleary . | |

*Primary Examiner*—James G. Smith
*Attorney, Agent, or Firm*—Albert W. Hilburger

[57] ABSTRACT

A hand guard is provided for use in combination with locking pliers having mutually hinged main and operating handles which are movable between opened and closed positions. It comprises a protective sleeve for conformable reception enveloping the mid-sectors of the locking pliers. The protective sleeve includes first and second opposed spaced apart panels and upper and lower opposed spaced apart panels for receiving the main and operating handles therebetween. The protective sleeve is of resiliently stretchable material such that when the locking pliers are in the closed position, the upper panel conformingly engages the main handle and the lower panel conformingly engages the operating handle and the first and second panels are substantially planar, extending, respectively, between the upper and lower panels, and when the locking pliers are in the opened position, the first and second panels are drawn into a reformed configuration while biasing the operating handle toward the closed position. The protective sleeve thereby prevents any portion of the hand of a user from entering a zone of the locking pliers between the main and operating handles.

18 Claims, 3 Drawing Sheets

HAND GUARD FOR LOCKING PLIERS

BACKGROUND OF THE INVENTION

1. Field of the Invention

This invention relates generally to protective devices for hand tools and, more particularly, to a hand guard for locking pliers which protects a user's hands against injury. More specifically, the invention is a protective sleeve which is conformably received on the locking pliers such that it prevents any portion of the hand of a user from entering a zone of the locking pliers between the main and operating handles thereof.

2. Description of the Prior Art

In the past, numerous devices have been used in conjunction with hand tools to improve the comfort of the user, for adjustment, or to change its mode of operation.

The following U.S. patents are typical of known constructions of such devices.

In one instance, U.S. Pat. No. 4,811,637 issued Mar. 14, 1989 to McCleary discloses a detachable hand protection device constructed of an elastomeric polymeric composition which interfits over one or both ends of one-piece hand wrenches of either open ended or closed ended configuration.

In another instance, U.S. Pat. No. 4,571,808 issued Feb. 25, 1986 to King discloses a pliers-type hand tool with vinyl or rubber grips received over the ends of each handle member. The grips are described as being generally cylindrical or hollow molded members encircling the handle ends of the hand tool.

In still another instance, U.S. Pat. No. 2,409,627 issued Oct. 22, 1946 to Helgeson discloses a quick adjustable wrench with a slide of U-shaped configuration which cooperates with the handles to achieve various positions of juxtaposed, mating jaws which are integral, respectively, with the handles. The slide is a part of the wrench and is mandatory for its operation.

In yet another instance, U.S. Pat. No. 2,293,002 issued Aug. 11, 1942 to Huffman discloses an adjustable wrench with a pair of rigid bands, one of which encircles, behind opposed jaw members, opposed shanks of opposed elongated body members, the other of which encircles opposed handles. The rigid bands operate as cams and cooperate with springs and ratchet teeth and pawls for adjusting and fixing the jaw opening to a desired size.

Finally, in this regard, U.S. Pat. No. 801,151 issued Oct. 3, 1905 to McKeever discloses a combination wrench and screw driver including a pair of shanks pinned together for relative pivotal movement. A mechanism is provided to enable the user to choose whether to use the tool as a wrench or as a screw driver.

However, no apparatus is known to the inventor to protect a person's hand from being pinched, cut, or crushed in a locking pliers. It was with knowledge of the prior art as just described that the present invention was conceived and has now been reduced to practice.

SUMMARY OF THE INVENTION

The present invention relates to a hand guard intended for use in combination with locking pliers having mutually hinged main and operating handles which are movable between opened and closed positions. It comprises a protective sleeve for conformable reception enveloping the mid-sectors of the locking pliers. The protective sleeve includes first and second opposed spaced apart panels and upper and lower opposed spaced apart panels for receiving the main and operating handles therebetween. The protective sleeve is of resiliently stretchable material such that when the locking pliers are in the closed position, the upper panel conformingly engages the main handle and the lower panel conformingly engages the operating handle and the first and second panels are substantially planar, extending, respectively, between the upper and lower panels, and when the locking pliers are in the opened position, the first and second panels are drawn into a reformed configuration while biasing the operating handle toward the closed position. The protective sleeve thereby prevents any portion of the hand of a user from entering a zone of the locking pliers between the main and operating handles.

The protective sleeve is preferably of single piece construction utilizing a rubber-like material or stretchable fabric material. In another embodiment, the first and second panels may have a thicker base region and a centrally located contoured region having a thickness less than that of the base region and shaped for controlling the resilience of the protective sleeve. In still another embodiment, the protective sleeve may have a plurality of parallel, spaced apart markings on the first and second panels extending between the upper and lower panels for indicating loci for cutting the panel for selective removal of material to accommodate the length of the locking pliers intended to receive the protective sleeve thereon. In yet another embodiment of the invention, the lower panel may include a tail member having a recess therein for engageably receiving the tip end of the operating handle of the locking pliers. In a further embodiment, the thickness of the protective sleeve diminishes with increased distance from its forward edge toward its rearward edge. In yet a further embodiment, the first panel is discontinuous and has opposed, generally parallel, termination edges and overlapping first and second flap members and the first and second panels include pressure sensitive engagement means for selectively attaching the first and second flap members together. Another benefit of the invention results by reason of the fact that the protective sleeve biases the locking pliers toward the closed position in engagement with the object being held.

Accordingly, a primary object of the present invention is to provide a protective sleeve which is conformably received on a locking pliers such that it prevents any portion of the hand of a user from entering a zone of the locking pliers between the main and operating handles thereof.

Another object of the present invention is to provide such a protective sleeve which will cover the locking pliers from the location of a forward rivet or pivot point back to near the end of an operating handle thereof.

A further object of the present invention is to provide such a protective sleeve which has the ability to stretch when the locking pliers is opened to accommodate an object between its jaws, yet to protect the user's hand against being cut, pinched, or crushed between the main and operating handles of the locking pliers when it is closed.

Still another object of the invention is to provide such a protective sleeve which is made of any suitable elastic, rubber-like, or stretchable type material either alone or in conjunction with any other type of malleable or hard plastic. Nor are other materials such as canvas or natural (e.g. cotton) or man-made or synthetic (e.g. nylon) material to be excluded for purposes of the invention.

Yet a further object of the present invention is to provide such a protective sleeve which will provide the user with an improved grip on the locking pliers and also provide a good insulator to electricity.

Yet another object of the invention is to provide such a system which is size adjustable to accommodate a broad range of sizes of locking pliers.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
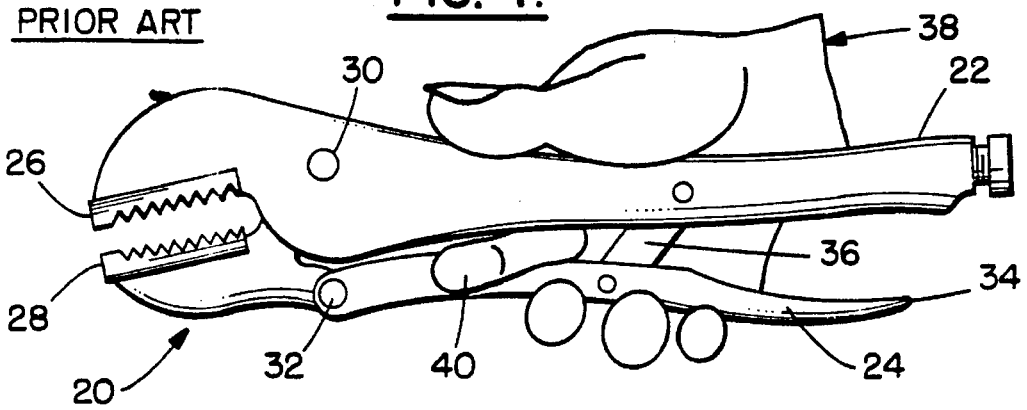
FIG. 1. PRIOR ART
FIG. 1 is a side elevation view of a conventional locking pliers and illustrating a harmful position of a hand of a user who would benefit from the invention.

Turn now to the drawings and, initially, to FIG. 1 which generally illustrates a conventional locking pliers 20 having, mutually hinged, a main handle 22 and an operating handle 24 movable between opened and closed positions. The locking pliers 20 may be of the type commonly known by the trademark VICE-GRIP®. The locking pliers 20 typically include opposed upper and lower gripping jaws 26, 28, respectively, for engageably receiving an object therebetween. It is customary for the upper gripping jaw to be integral with the main handle 22 and for the lower gripping jaw to be pivotally mounted on the main handle by means of a rivet or hinge 30. In turn, the operating handle 24 is pivoted at a forward end 32 to the lower gripping jaw 28 and intermediate its forward end and an aft end 34 is pivoted to a link 36 which extends to, and is pivotally attached to, the main handle 22.

As pictorially represented in FIG. 1, it occurs on occasion that a hand 38 of a user of the locking pliers 20 may become cut or pinched, or crushed as the main and operating handles 22, 24 are moved between open and closed positions. In FIG. 1, for example, a finger 40 is shown undesirably extending across and between and through their operating zone.

To prevent such an occurrence, the invention provides a hand guard (FIGS. 2 and 3) which comprises a protective sleeve 42 for conformable reception onto and over the main and operating handles of the locking pliers. The protective sleeve includes first and second opposed spaced apart panels 44, 46, respectively, for receiving the locking pliers therebetween and upper and lower opposed spaced apart panels 48, 50, respectively, for receiving the main and operating handles therebetween.

Figure 2:
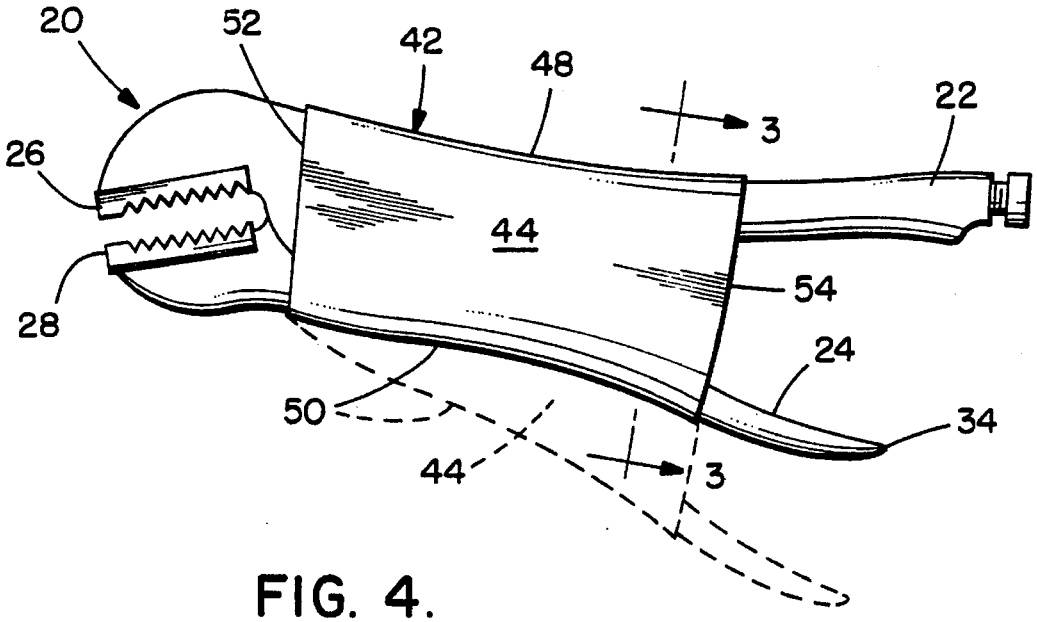
FIG. 2 is a side elevation view of the conventional locking pliers of FIG. 1 modified to include a conformably received protective sleeve thereon in accordance with the invention.
Figure 3:
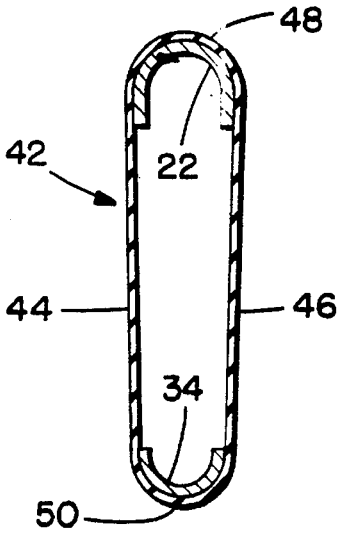
FIG. 3 is a cross section view taken generally along line 3—3 in FIG. 2.

The protective sleeve is of resiliently stretchable material such that when operatively positioned on the locking pliers in the closed position, as indicated by solid lines in FIG. 2, the upper panel 48 conformingly engages the main handle 22, the lower panel 50 conformingly engages the operating handle 24, and the first and second panels 44, 46 are substantially planar, extending, respectively, between the upper and lower panels. Furthermore, when the locking pliers are moved to the opened position as depicted by dashed lines in FIG. 2, the first and second panels are drawn into a reformed configuration while biasing the operating handle toward the closed (solid line) position.

With this construction, the protective sleeve 42 would be slipped onto the locking pliers from the forward end thereof, over the gripping jaws 26, 28, coming to rest such that a forward edge 52 would come to rest just aft of the gripping jaws and overlying the pivot 30 and forward end 32 of the operating handle 24. A rear edge 54 would extend to a location to assure that the sleeve overlies the link 36 and its pivots but some distance yet from the aft end 34 of the operating handle. The protective sleeve 42 thereby prevents any portion of the hand 38 of a user from entering a zone of the locking pliers between the main and operating handles.

As illustrated, the protective sleeve is preferably of single piece construction and is preferably of a rubber-like material or of a stretchable fabric material.

Figure 4:
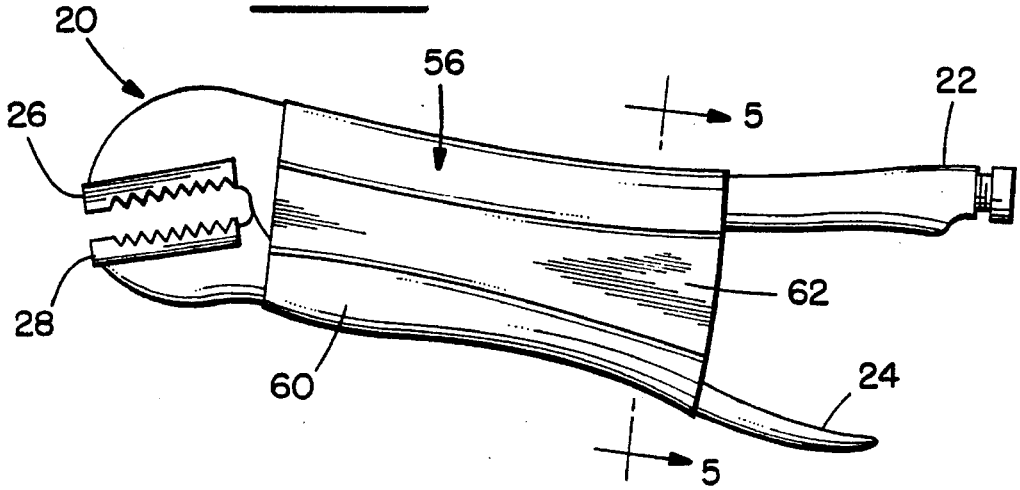
FIG. 4 is a side elevation view of the conventional locking pliers of FIG. 1 modified in accordance with another embodiment of the invention.
Figure 5:
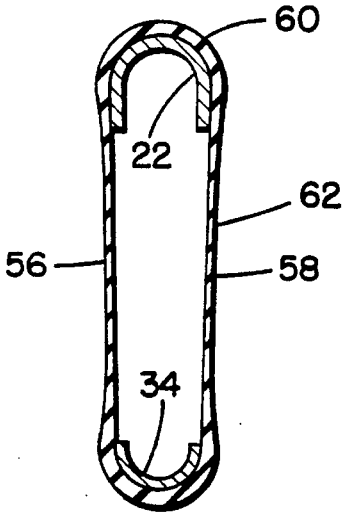
FIG. 5 is a cross section view taken generally along line 5—5 in FIG. 4.

Turn now to FIGS. 4 and 5 for another embodiment of the invention. In this instance, modified first and second panels, 56, 58, respectively, have each a base region 60 and a centrally located contoured region 62 having a thickness equal to or less than the base region and shaped for controlling the resilience of the protective sleeve. The contoured regions 62 may also increase the comfort of use of the locking pliers 20 for the user. As indicated in FIG. 5, the contoured regions 62 may be integral with and of the same material as the base regions 60.

Figure 6:
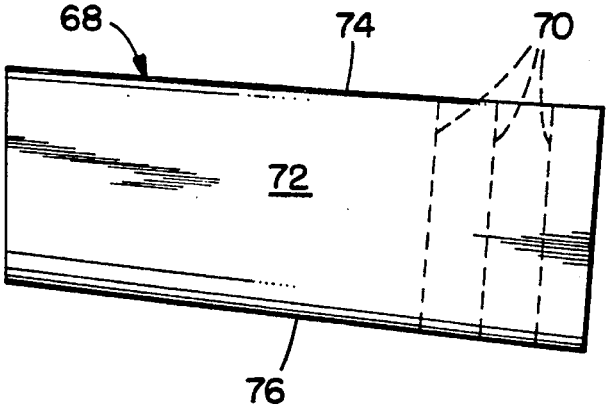
FIG. 6 is a side elevation view of another embodiment of the protective sleeve of the invention.

Another embodiment is illustrated in FIG. 6 wherein a modified protective sleeve 68 has a plurality of parallel, spaced apart markings 70 on panels 72 extending between upper and lower panels 74, 76 indicating loci for cutting the sleeve for selective removal of material to accommodate the length of a specific size of locking pliers intended to receive the protective sleeve.

Figure 7:
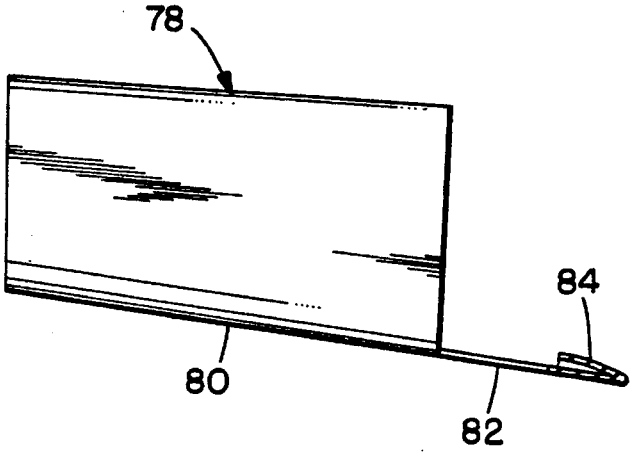
FIG. 7 is a side elevation view of still another embodiment of the protective sleeve of the invention.
Figure 8:
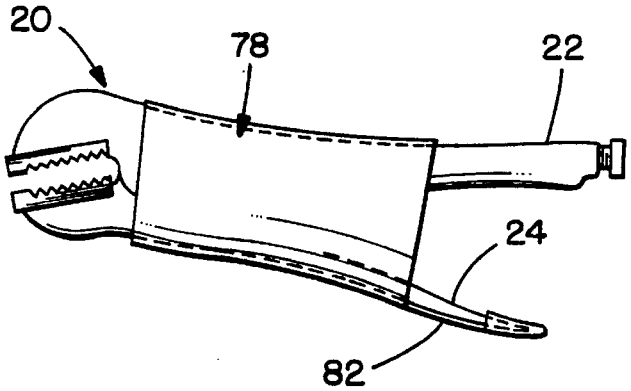
FIG. 8 is a side elevation view of the conventional locking pliers of FIG. 1 modified in accordance with the embodiment illustrated in FIG. 7.

In still another embodiment of the invention, as seen in FIGS. 7 and 8, a modified sleeve 78 has a lower panel 80 which includes a tail member 82 having a recess 84 therein for engageably receiving the aft end 34 of the operating handle 24. With this construction, as the main and operating handles of the locking pliers are moved to the opened position, any tendency of the sleeve 78 to slide along the handles in the direction of the gripping jaws 26, 28 would be arrested. This construction may be desirable from an aesthetic standpoint as well.

Figure 9:
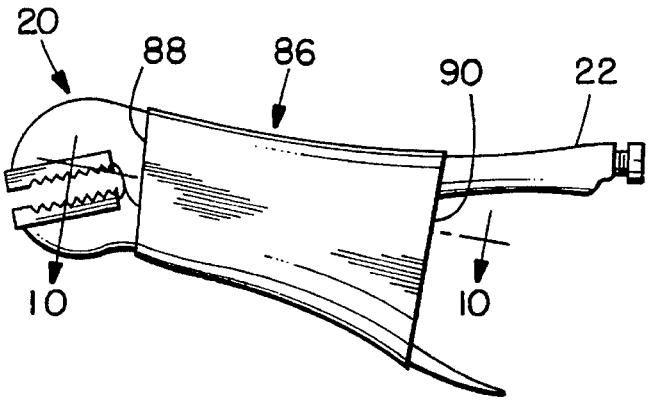
FIG. 9 is a side elevation view of the conventional locking pliers of FIG. 1 modified in accordance with yet another embodiment of the invention.
Figure 10:
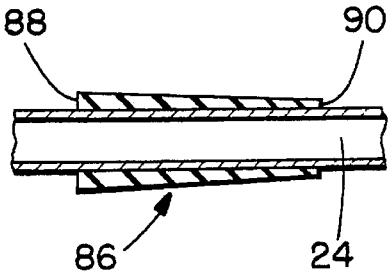
FIG. 10 is a cross section view taken generally along line 10—10 in FIG. 9.

Yet another embodiment of the invention is illustrated in FIGS. 9 and 10. In this instance, the thickness of a modified protective sleeve 86 diminishes with increased distance from a forward edge 88 toward a rearward edge 90. By so constructing the protective sleeve 86, the ease of opening and closing the main and operating handles 22, 24 can be controlled. This construction recognizes the fact that the ends of the main and operating handles distant from the gripping jaws 26, 28 travel through greater arcs than do parts of them closer to the gripping jaws. For that reason, the protective sleeve 86 accordingly would be desirably thinner at the rearward edge than at the forward edge.

Figure 11:
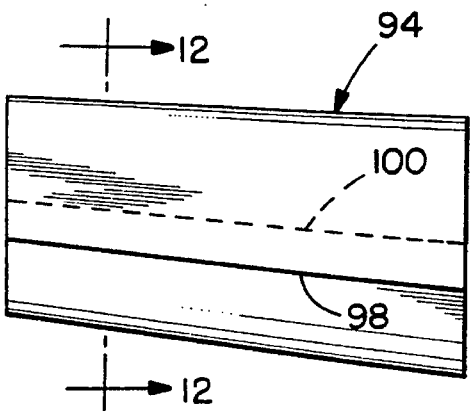
FIG. 11 is a side elevation view of yet another embodiment of the protective sleeve of the invention.
Figure 12:
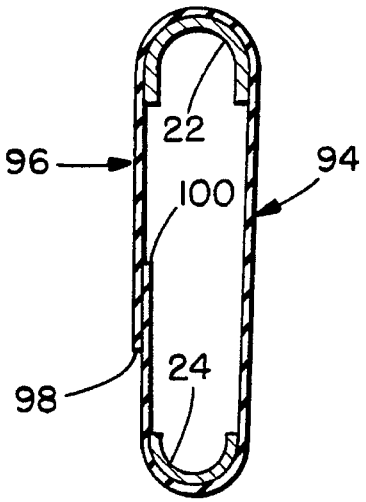
FIG. 12 is a cross section view taken generally along line 12—12 in FIG. 11.
Figure 13:
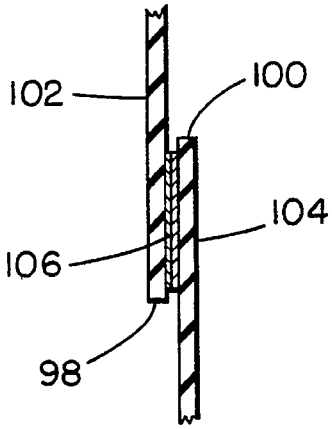
FIG. 13 is a detail cross section view illustrating in greater detail a part of the construction illustrated in FIG. 12.

Yet a further embodiment of the invention is illustrated in FIGS. 11–13. In this instance, a modified protective sleeve 94 has a discontinuous first panel 96 which includes opposed, generally parallel, termination edges 98, 100 and overlapping first and second flap members 102, 104. The first and second flap members 102, 104 include pressure sensitive engagement devices 106 for selectively attaching said first and second flap members together. The engagement devices 106 may be, for example, mechanical snaps, adhesive, or hook and loop fastening material such as that marketed under the trademark VELCRO®. In this manner, a variety of sizes of locking pliers 20 can be accommodated. In another modified embodiment, not illustrated, each of the opposed lateral panels may be so constructed.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A hand guard for locking pliers having mutually hinged main and operating handles movable between opened and closed positions, said hand guard comprising:

a protective sleeve for conformable reception onto and over the main and operating handles of the locking pliers, said protective sleeve including:

first and second opposed spaced apart panels for receiving the locking pliers therebetween; and upper and lower opposed spaced apart panels for receiving the main and operating handles therebetween;

said protective sleeve being of resiliently stretchable material such that when operatively positioned on the locking pliers in the closed position, said upper panel conformingly engages the main handle thereof, said lower panel conformingly engages the operating handle thereof, and said first and second panels are substantially planar, extending, respectively, between said upper and lower panels, and such that when operatively positioned on the locking pliers in the opened position, said first and second panels are drawn into a reformed configuration while biasing the operating handle toward the closed position;

said protective sleeve thereby preventing any portion of the hand of a user from entering a zone of the locking pliers between the main and operating handles.

2. A hand guard as set forth in claim 1 wherein said protective sleeve is of single piece construction.

3. A hand guard as set forth in claim 1 wherein said first and second panels have a base region and a centrally located contoured region having a thickness no greater than said base region and shaped for controlling the resilience of said protective sleeve.

4. A hand guard as set forth in claim 1 wherein said protective sleeve is of a rubber-like material.

5. A hand guard as set forth in claim 1 wherein said protective sleeve is of a stretchable fabric material.

6. A hand guard as set forth in claim 1 wherein said protective sleeve has a plurality of parallel, spaced apart markings on said first and second panels extending between said upper and lower panels for indicating loci for severing said panel for selective removal of material of said panel to accommodate the length of a locking pliers intended to receive said protective sleeve thereon.

7. A hand guard as set forth in claim 1 wherein said protective sleeve extends from a forward edge adjacent gripping jaws of the locking pliers and a rearward edge distant from the jaws thereof; and wherein said lower panel includes an extension member which terminates at a tail member having a recess therein for engageably receiving an aft end of the operating handle for the locking pliers and prevents forward movement of said protective sleeve toward the gripping jaws of the locking pliers when the operating handle of the locking pliers is moved to the opened position.

8. A hand guard as set forth in claim 1 wherein said protective sleeve extends from a forward edge adjacent gripping jaws of the locking pliers and a rearward edge distant from the jaws thereof; and wherein the thickness of said protective sleeve diminishes with increased distance from said forward edge toward said rearward edge.

9. A hand guard as set forth in claim 1 wherein said first panel is discontinuous and has opposed, generally parallel, termination edges and overlapping first and second flap members; and wherein said first and second panels include pressure sensitive engagement means for selectively attaching said first and second flap members together.

10. In combination with locking pliers having mutually hinged main and operating handles movable between opened and closed positions, a hand guard comprising:

a protective sleeve for conformable reception onto and over said main and operating handles of said locking pliers, said protective sleeve including:

first and second opposed spaced apart panels for receiving said locking pliers therebetween; and upper and lower opposed spaced apart panels for receiving said main and operating handles therebetween;

said protective sleeve being of resiliently stretchable material such that when operatively positioned on said locking pliers in the closed position, said upper panel conformingly engages said main handle thereof, said lower panel conformingly engages said operating handle thereof, and said first and second panels are substantially planar, extending, respectively, between said upper and lower panels, and such that when operatively positioned on said locking pliers in the opened position, said first and second panels are drawn into a reformed configuration while biasing said operating handle toward the closed position;

said protective sleeve thereby preventing any portion of the hand of a user from entering a zone of said locking pliers between said main and operating handles.

11. A hand guard as set forth in claim 10 wherein said protective sleeve is of single piece construction.

12. A hand guard as set forth in claim 10 wherein said first and second panels have a base region and a centrally located contoured region having a thickness no greater than said base region and shaped for controlling the resilience of said protective sleeve.

13. A hand guard as set forth in claim 10 wherein said protective sleeve is of a rubber-like material.

14. A hand guard as set forth in claim 10 wherein said protective sleeve is of a stretchable fabric material.

15. A hand guard as set forth in claim 10 wherein said protective sleeve has a plurality of parallel, spaced apart markings on said first and second panels extending between said upper and lower panels for indicating loci for cutting said panel for selective removal of material to accommodate the length of the locking pliers intended to receive said protective sleeve thereon.

16. A hand guard as set forth in claim 10 wherein said locking pliers includes opposed gripping jaws adjacent a forward end thereof;

wherein said operating handle extends to an aft end distant from said gripping jaws; and wherein said lower panel includes a tail member having a recess therein for engageably receiving said aft end of said operating handle.

17. A hand guard as set forth in claim 10 wherein said locking pliers includes opposed gripping jaws adjacent a forward end thereof;

wherein said protective sleeve extends from a forward edge adjacent said gripping jaws and a rearward edge distant from said gripping jaws; and wherein the thickness of said protective sleeve diminishes with increased distance from said forward edge toward said rearward edge.

18. A hand guard as set forth in claim 10 wherein said first panel is discontinuous and has opposed, generally parallel, termination edges and overlapping first and second flap members; and wherein said first and second panels include pressure sensitive engagement means for selectively attaching said first and second flap members together.

* * * * *